US010568487B2

(12) United States Patent
Hong et al.

(10) Patent No.: US 10,568,487 B2
(45) Date of Patent: Feb. 25, 2020

(54) HEATING CIRCULATION TYPE DRYING MODULE OF DISHWASHER

(71) Applicant: LG ELECTRONICS INC., Seoul (KR)

(72) Inventors: Woo Hong, Seoul (KR); Sangwoo Woo, Seoul (KR); Seonhwa Yu, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 12 days.

(21) Appl. No.: 15/318,274

(22) PCT Filed: Jun. 10, 2016

(86) PCT No.: PCT/KR2016/006171
§ 371 (c)(1),
(2) Date: Dec. 12, 2016

(87) PCT Pub. No.: WO2016/200198
PCT Pub. Date: Dec. 15, 2016

(65) Prior Publication Data

US 2017/0196431 A1 Jul. 13, 2017

(30) Foreign Application Priority Data

Jun. 11, 2015 (KR) ..... 10-2015-0082722

(51) Int. Cl.
*A47L 15/48* (2006.01)
*A47L 15/00* (2006.01)

(52) U.S. Cl.
CPC ..... *A47L 15/0034* (2013.01); *A47L 15/486* (2013.01); *A47L 15/488* (2013.01); (Continued)

(58) Field of Classification Search
None
See application file for complete search history.

(56) References Cited

U.S. PATENT DOCUMENTS 4,326,552 A * 4/1982 Bleckmann ..... A47L 15/4285 134/102.3
2015/0342441 A1* 12/2015 Hahm ..... A47L 15/481 34/79

FOREIGN PATENT DOCUMENTS

CN 1927111 A 3/2007
CN 101193582 A 6/2008
(Continued)

OTHER PUBLICATIONS

English machine translation of KR102014010163. Provided by KIPO on Feb. 2, 2013 to EPO. (Year: 2013).*

*Primary Examiner* — Michael E Barr
*Assistant Examiner* — Jason P Riggleman
(74) *Attorney, Agent, or Firm* — Dentons US LLP

(57) ABSTRACT

Disclosed is a heating circulation type drying module of a dishwasher using a fan module and PTC heaters. The dishwasher includes a cabinet defining the external appearance, a tub provided in the cabinet, a door for opening or closing the tub, a flow-path unit for circulating air inside the tub through a suction port and an exhaust port, which communicate with the tub, a suction duct for communicating with the suction port, an exhaust duct for communicating with the suction duct and the exhaust port, at least two heaters provided inside the exhaust duct for heating the air, and a fan for supplying the air to the heaters. The dishwasher may achieve improved drying performance via adjustment in the temperature of air to be discharged, and may reduce power consumption via omission of a rinsing water heating course.

11 Claims, 5 Drawing Sheets

(52) U.S. Cl.
CPC ..... *A47L 2401/04* (2013.01); *A47L 2401/19* (2013.01); *A47L 2401/20* (2013.01); *A47L 2501/11* (2013.01); *A47L 2501/12* (2013.01); *A47L 2501/22* (2013.01); *A47L 2501/30* (2013.01)

(56) References Cited

FOREIGN PATENT DOCUMENTS

| | | | | | |
|---|---|---|---|---|---|
| CN | 101657140 | A | | 2/2010 | |
| CN | 102209486 | A | | 10/2011 | |
| CN | 102813494 | A | | 12/2012 | |
| CN | 103976698 | A | | 8/2014 | |
| EP | 1674030 | A1 | | 6/2006 | |
| EP | 2372012 | A1 | * | 10/2011 | ..... A47L 15/483 |
| JP | 11276415 | | * | 10/1999 | |
| JP | 2008-540027 | A | | 11/2008 | |
| JP | 2015-073787 | A | | 4/2015 | |
| KR | 10-2006-0015828 | A | | 2/2006 | |
| KR | 10-1435838 | A | | 12/2009 | |
| KR | 10-2011-0139538 | A | | 12/2011 | |
| KR | 10-2014-0101631 | A | | 8/2014 | |
| KR | 1020140101631 | | * | 8/2014 | |
| WO | 2009/008828 | A1 | | 1/2009 | |

* cited by examiner

[Fig. 1]
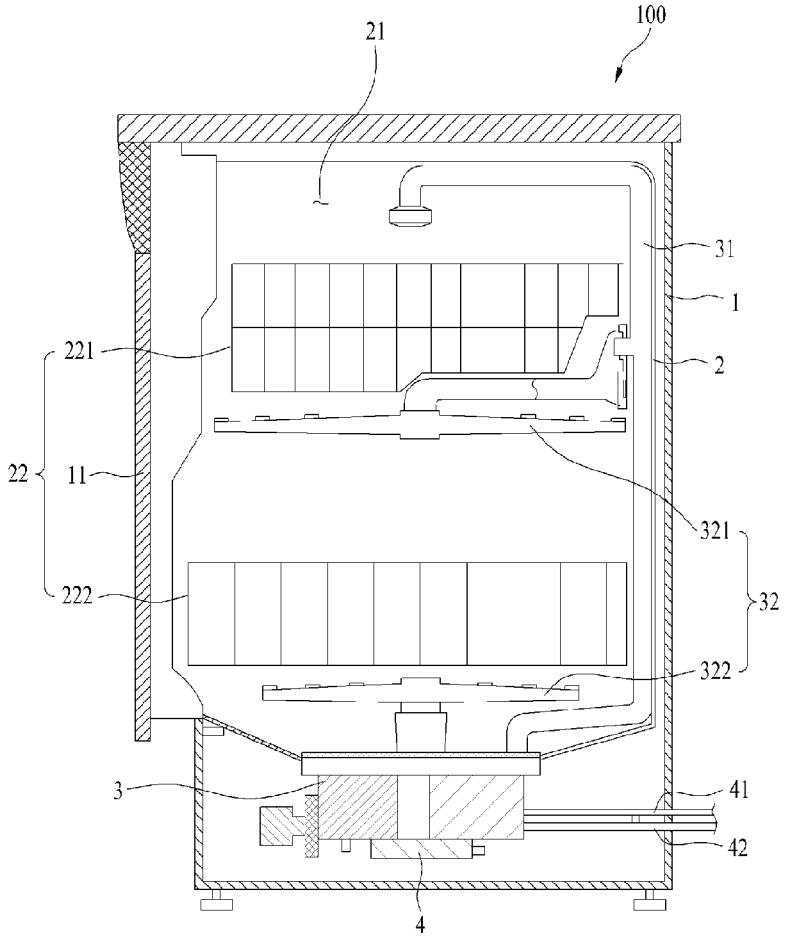

[Fig. 2]
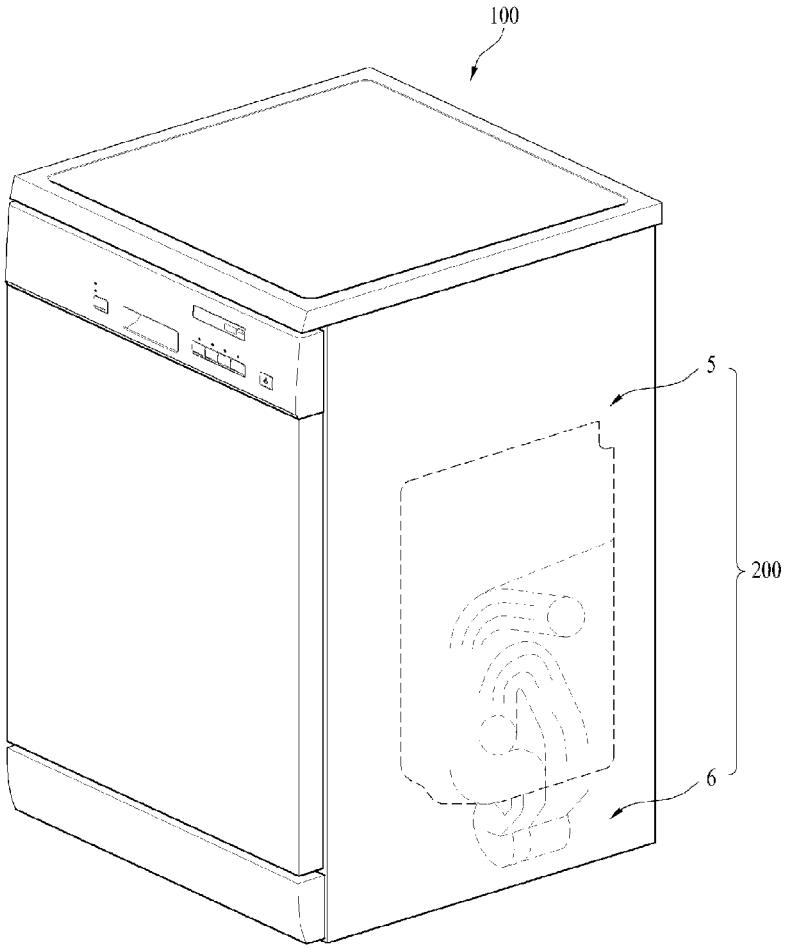

[Fig. 3]
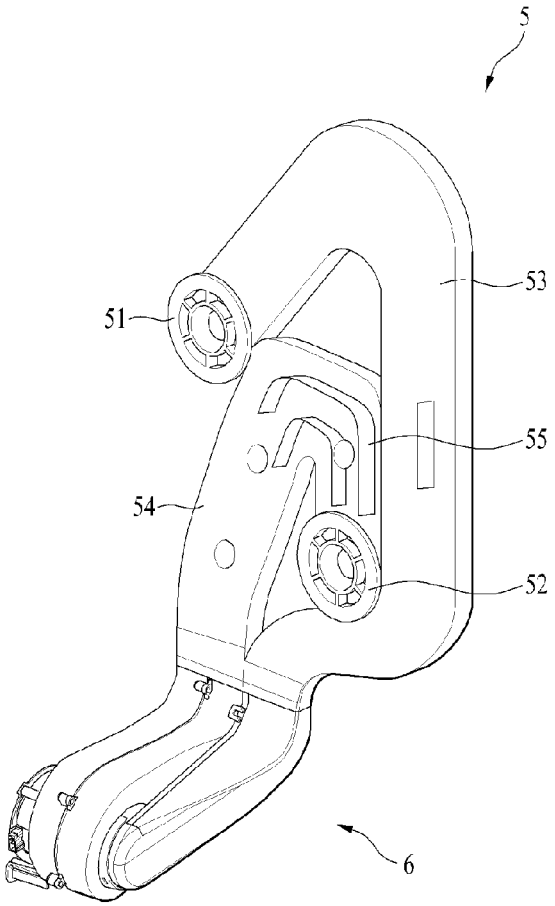
[Fig. 4]
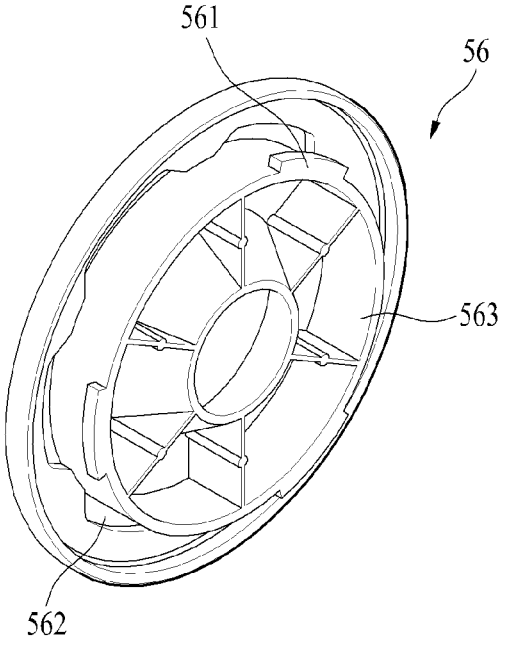

[Fig. 5]
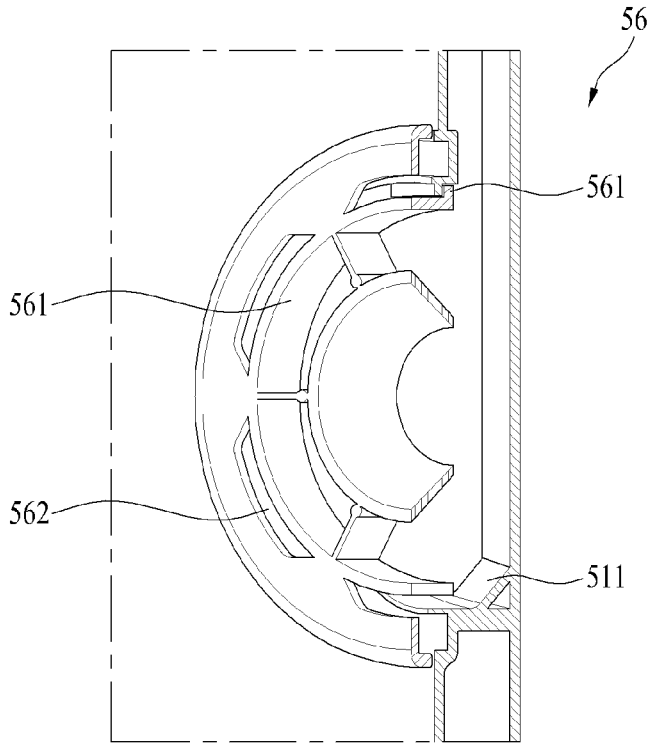
[Fig. 6]
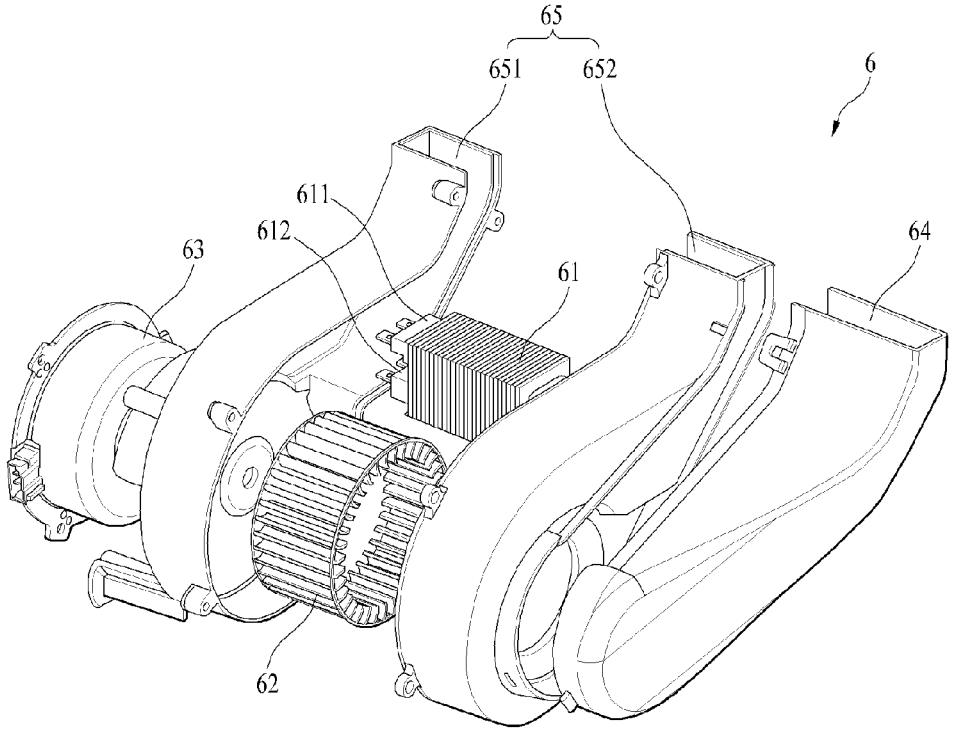

[Fig. 7]
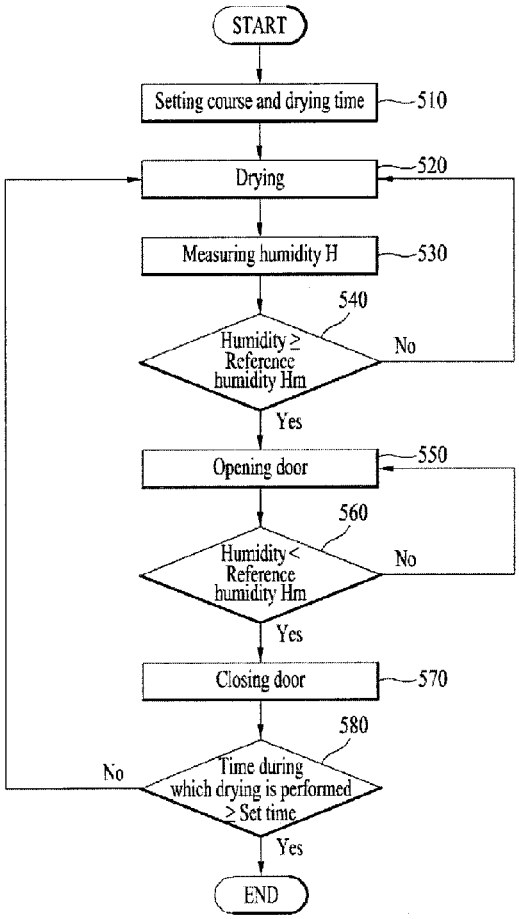

HEATING CIRCULATION TYPE DRYING MODULE OF DISHWASHER

This application is a National Stage Application of International Application No. PCT/KR2016/006171, filed on Jun. 10, 2016, which claims the benefit of Korean Patent Application No. 10-2015-0082722, filed on Jun. 11, 2015, all of which are hereby incorporated by reference in their entirety for all purposes as if fully set forth herein.

TECHNICAL FIELD

The present invention relates to a dishwasher, and more particularly, to a dishwasher, which removes water from dishes by heating and circulating air inside a tub after a cycle of the dishwasher ends.

BACKGROUND ART

A dishwasher is a home appliance that removes leftover food adhered to the surface of dishes using high-pressure wash water ejected from ejection nozzles. The dishwasher includes, for example, a tub, which defines a wash container, and a sump mounted on the lower surface of the tub for storing wash water therein. The dishwasher performs a washing cycle, a rinsing cycle, and a drying cycle in sequence.

A dishwasher having a drying function includes a drying device for removing moisture from dishes by supplying heated air into the tub. The drying device may include, for example, a heater for heating air, and a blowing fan for blowing the air heated by the heater. In addition, the dehumidification of moist air during drying is generally performed using Zeolite, or a heat pump system.

A conventional drying method includes a rinsing course. After water is heated in the rinsing course, the heated water is discharged into the tub so as to allow dishes to store thermal energy whereby the moisture on the surface of the dishes are evaporated using the latent heat of the dishes. Therefore, a lot of power is consumed when the water is heated.

DISCLOSURE

Technical Problem

Therefore, the present invention has been made in view of the above problem of the related art, and it is an object of the present invention to achieve a reduction in power consumption through the omission of a water heating course and high drying performance using only hot air, as a result of evaporating water on the surface of dishes by heating only air using a drying module without a heating rinsing course, which is the typical drying method of a dishwasher.

It is another object of the present invention to achieve an increase in drying performance by adjusting the temperature of dry air based on the kind and quantity of objects to be dried.

It is another object of the present invention to achieve the uniform drying of different regions inside a tub by adjusting the flow rate of dry air so as to induce variation in the circulation pattern of air inside the tub.

It is a further object of the present invention to achieve a reduction in power consumption required for dehumidification by discharging moist air circulating inside a tub to the outside.

Technical Solution

In accordance with an aspect of the present invention, the above and other objects can be accomplished by the provision of a dishwasher including a cabinet, a tub provided in the cabinet for providing a washing space, a door for opening or closing the tub, a flow-path unit for circulating air inside the tub through a suction port and an exhaust port, which communicate with the tub, a suction duct for communicating with the suction port, an exhaust duct for communicating with the suction duct and the exhaust port, at least two heaters provided inside the exhaust duct for heating the air, and a fan for supplying the air to the heaters. Power consumption may be reduced because air is used to dry dishes, and drying efficiency may be increased because the temperature of dry air is adjustable. In addition, the flow rate of air may be adjusted by adjusting the rotation of a fan, and power consumption for dehumidification may be reduced by discharging moist air to the outside through an opened door.

The heaters may be controlled independently of each other so as to adjust a temperature of the air and to increase drying performance The door may be opened at least one time during operation of the heaters, which may reduce power consumption.

The door may remain opened when the air inside the tub reaches a reference humidity, and the humidity inside the tub may be reduced without power consumption.

When the air inside the tub reaches a prescribed temperature, the door may remain opened.

The heaters may be positive temperature coefficient (PTC) heaters, which may reduce power consumption.

An RPM of the fan may be changed at least one time during operation of the heaters, which may allow dry air to be evenly distributed inside the tub.

The door may be opened simultaneously with a change in the RPM of the fan.

The flow-path unit may include a suction flow-path for connecting the suction port and the suction duct to each other, and an exhaust flow-path for connecting the exhaust port and the exhaust duct to each other, and each of the suction flow-path and the exhaust flow-path may extend upward from the suction port or the exhaust port by a prescribed distance in order to prevent introduction of wash water.

The suction port may be located higher than the exhaust port, which serves to facilitate the circulation of air inside the tub.

The exhaust flow-path may be provided with a rib for assisting a flow of air from the exhaust duct to the exhaust port.

Each of the suction port and the exhaust port may be provided at an end thereof with a drain hole in order to discharge the wash water, introduced into the suction port or the exhaust port, to an inside of the tub.

Each of the suction port and the exhaust port may have a circular passage in a central portion thereof, and a plurality of conical passages may be provided around the circular passage, which allows the dry air to be evenly supplied into the tub.

The dishwasher may further include an upper rack provided inside the tub, and a lower rack provided under the upper rack, and the exhaust port may be located at the same height as the lower rack, which allows the dry air to be directly supplied to dishes, resulting in improved drying performance.

A circumferential surface forming the suction port and the exhaust port may be inclined toward the tub so as to drain the wash water, introduced into the suction port and the exhaust port, to an inside of the tub.

In accordance with another aspect of the present invention, there is provided a control method of a dishwasher including setting a washing course and a drying time, drying dishes, measuring a humidity inside the dishwasher, comparing the measured humidity with a preset reference humidity, and opening a door when the humidity inside the dishwasher is higher than or equal to the reference humidity.

The drying may be continuously performed when the humidity measured in the measuring is lower than the reference humidity.

The control method may further include comparing the humidity inside the dishwasher with the reference humidity after the door is opened, and the door may remain opened when the humidity inside the dishwasher is higher than the reference humidity, and the door may be closed when the humidity inside the dishwasher is lower than the reference humidity.

Advantageous Effects

The present invention has the effect of reducing energy usage by 20~30% compared to the conventional energy usage by omitting the course of heating final rinsing water at a high temperature.

The present invention has the effect of improving drying performance by independently controlling two or more heating units so as to adjust the temperature of the air to be discharged.

The present invention may adjust the flow rate of air differently for different operation periods by varying the RPM of a fan in respective operations, and may dry different regions in a drying rack by varying the circulation flow pattern of air inside a tub.

The present invention may prevent additional power consumption for dehumidification by discharging moist air to the outside through an opened door.

DESCRIPTION OF DRAWINGS

The accompanying drawings, which are included to provide a further understanding of the invention, illustrate embodiments of the invention and together with the description serve to explain the principle of the invention.

In the drawings:

FIG. 1 is a sectional view illustrating a dishwasher in accordance with one embodiment of the present invention;

FIG. 2 is a perspective view illustrating a flow-path unit and a heating unit attached to the side surface of the dishwasher in accordance with one embodiment of the present invention;

FIG. 3 is a perspective view illustrating the flow-path unit and the heating unit;

FIG. 4 is a perspective view illustrating the shape of a cap;

FIG. 5 is a perspective view illustrating a drain hole in the cap

FIG. 6 is a perspective view illustrating the heating unit; and

FIG. 7 is a flowchart illustrating a control method of a dishwasher.

BEST MODE

Hereinafter, exemplary embodiments of the present invention will be described in detail with reference to the accompanying drawings. Meanwhile, the configuration of an apparatus or a control method thereof, which will be described below, is merely given to describe the embodiments of the present invention, without being intended to limit the scope of the present invention. Throughout the specification, the same reference numerals designate the same constituent elements.

As illustrated in FIG. 1, a dishwasher 100 in accordance with one embodiment of the present invention basically includes a cabinet 1, which defines the external appearance of the dishwasher, a tub 2 provided in the cabinet 1 for providing a washing space, a sump 3 coupled underneath the tub 2 for storing wash water therein, and a pump 4 for pumping the water in the sump 3. The cabinet 1 includes a door 11 for opening or closing the tub 2.

A wash chamber 21 for accommodating dishes therein is defined in the tub 2. A plurality of racks 22, on which the dishes may be placed, is installed in the wash chamber 21. The racks 22 include an upper rack 221 and a lower rack 222.

The wash water stored in the sump 3 passes through a connection pipe 31 and is ejected to the dishes placed on the racks 22 through ejection arms 32. The ejection arms 32 include an upper arm 321 located under the upper rack 221, and a lower arm 322 located under the lower rack 222. The upper arm 321 and the lower arm 332 are independently and rotatably installed, and each of the ejection arms 32 is provided with a plurality of ejection nozzles for ejecting wash water toward the dishes.

The wash water stored in the sump 3 may be supplied selectively or simultaneously to the upper arm 321 and the lower arm 322 through the connection pipe 31 by the pump 4.

The wash water stored in the sump 3 is introduced through a water supply pipe 41, and the wash water, after having been used to wash the dishes, is discharged to the outside of the dishwasher 100 through a drain pipe 42. The amount of water that is supplied and drained is adjusted using respective valves (not illustrated), which are installed on the water supply pipe 41 and the drain pipe 42.

Meanwhile, FIG. 2 illustrates the shape of a drying module 200 included in the dishwasher 100, and FIG. 3 also illustrates the shape of the drying module 200. The drying module 200 is comprised of a flow-path unit 5 and a heating unit 6, which serve to dry the dishes.

The flow-path unit 5 serves as a passage, which transmits air inside the tub 2 to the heating unit 6, or transmits the air heated in the heating unit 6 to the inside of the tub 2. The heating unit 6 serves to heat the air inside the tub 2 introduced thereinto through the flow-path unit 5.

The flow-path unit 5 may be located on one surface of the cabinet 1, which may communicate with the inside of the tub 2, and more particularly, may be located on the side surface or the rear surface of the cabinet 1, excluding the upper surface and the lower surface of the cabinet 1, which defines the external appearance of the dishwasher 100.

The heating unit 6 is provided so as to communicate with the flow-path unit 5. In addition, although the heating unit 6 has no limitation in terms of position so long as it is located inside the dishwasher 100, the heating unit 6 may be located in the lower region of the dishwasher 100, which has an available space because the sump 3 is installed in the lower region, in consideration of the fact that the remaining region in which the tub 2 is installed is important in defining the washing space.

The drying module 200 may be separably coupled to the dishwasher, or integrally formed with the dishwasher, or may be separately installed outside the dishwasher.

Referring to FIG. 3, the flow-path unit 5 includes, for example, a suction port 51 serving as the inlet for suctioning air circulated inside the tub 2, an exhaust port 52 serving as the outlet for discharging the suctioned air to the inside of the tub 2 after the air is dried, a suction flow-path 53 serving as the passage for communicating with the suction port 51 and transmitting the air to the heating unit 6, an exhaust flow-path 54 serving as the passage for communicating with the exhaust port 52 and transmitting the heated air from the heating unit 6 to the exhaust port 52, a rib 55 for facilitating the smooth flow of air to the suction flow-path 53 and the exhaust flow-path 54, and caps 56 provided on the suction port 51 and the exhaust port 52 for assisting the smooth collection and discharge of air.

The rib 55 is arranged in the suction flow-path 53 or the exhaust flow-path 54 in order to assist the stabilized flow of air. More specifically, a plurality of ribs 55 is arranged in the longitudinal direction of the suction flow-path 53 and the exhaust flow-path 54. The ribs 55 may be installed at a constant distance inside the suction flow-path 53 and the exhaust flow-path 54.

Referring to FIG. 5, at least one of an interface at which the tub 2 and the suction port 51 are connected to each other and an interface at which the tub 2 and the exhaust port 52 are connected to each other is provided with a slope 511 so as to allow wash water or contaminants introduced into the suction port 51 and the exhaust port 52 to be easily discharged to the inside of the tub 2.

Referring to FIG. 4, the cap 56 provided on the suction port 51 or the exhaust port 52 may cause the air suctioned through the suction port 51 to be evenly collected and may cause the hot air discharged through the exhaust port 52 to be evenly distributed the inside of the tub 2. In addition, the cap 56 functions to prevent wash water and contaminants from being deposited in the direction of gravity for a long time.

The cap 56 may be separably coupled to or integrally formed with the suction port 51 or the exhaust port 52. In the case of the separable cap 56, a plurality of hooks 561 is provided on the periphery of the cap 56 to facilitate easy coupling with the suction port 51 and the exhaust port 52.

In order to prevent wash water and contaminants from being deposited in the suction port 51 or the exhaust port 52, the cap 56 has a drain hole 562. Wash water and contaminants moved along the slope 51 provided on the suction port 51 or the exhaust port 52 are discharged through the drain hole 562.

The cap 56 is provided in the central portion thereof with a circular passage 564 and a plurality of conical passages 563. The circular passage 564 and the conical passages 563 may allow the air suctioned through the suction port 51 to be evenly collected and may allow the hot air discharged through the exhaust port 52 to be evenly distributed the inside of the tub 2.

The cross-section of the conical passages 563 may have an approximately trapezoidal shape, and the conical passages 563 may form a single circle so as to surround the circular passage 564.

The cap 56 is configured such that the cross section of the circular passage 564 closer to the tub 2 is larger than the cross section of the circular passage 564 closer to the suction port 51 or the exhaust port 52. In contrast, the cross section of the conical passages 563 closer to the tub 2 is smaller than the cross section of the conical passages 563 closer to the suction port 51 or the exhaust port 52. That is, when heated air is discharged from the exhaust flow-path 54 to the tub 2, the circular passage 564 is gradually widened, but the conical passages 563 are gradually narrowed. Likewise, when the air inside the tub 2 is introduced into the suction flow-path 53, the circular passage 564 is gradually narrowed, but the conical passages 563 are gradually widened.

FIG. 6 is a perspective view of the heating unit 6. The heating unit 6 serves to heat the air inside the tub 2 supplied from the flow-path unit 5 so as to again supply the heated air to the flow-path unit 5. In addition, the heating unit 6 may adjust the temperature to which the air is heated and may also adjust the flow rate of the heated air.

The heating unit 6 may include a heater 61 for heating the air supplied from the flow-path unit 5, a fan 62 for assisting the circulation of air, a motor 63 for rotating the fan 62, a suction duct 64 for communicating with the flow-path unit 5 so as to receive the air, and an exhaust duct 65 for communicating with the flow-path unit 5 so as to discharge the heated air.

The heating unit 6 may include a plurality of heaters 61 for heating the supplied air, and the respective heaters 6 may be independently controlled. In addition, the respective heaters may be positive temperature coefficient (PTC) heaters.

A PTC heater is a heater that may be controlled so that the temperature is no longer increased when reaching a given level, and has very low power consumption compared to other kinds of heaters. In addition, the temperature of the air to be discharged may be adjusted by independently controlling two or more heaters 61. In the present invention, through the use of the PTC heaters, a separate temperature sensor is not required, and the temperature of the air to be discharged may be adjusted without a controller.

In the embodiment of the present invention, there are provided two heaters 61 including a first heater 611 and a second heater 612. The temperature of the air may be increased or reduced by independently controlling the respective heaters 61.

Evaporating remaining moisture becomes more difficult as the drying course is performed. In order to solve this problem, two or more heaters 61 may be provided so that the number of heaters 61 being operated is gradually increased while the drying course is performed. This is because one heater 61 may be insufficient to evaporate the moisture remaining inside the tub towards the end of the drying procedure. Thus, when all of two or more heaters 61 are operated, additional heat required for the evaporation of moisture may be acquired.

The heaters 61 may be installed at any place inside the heating unit 6 so long as air flows through the place. In the embodiment of the present invention, the heaters 61 are located inside the exhaust duct 65.

Because the fan 62 also serves to assist the circulation of air, the fan 62 may be installed at any place inside the heating unit 6 so long as it can adjust the flow rate of air. In the embodiment of the present invention, the heaters 61 may be installed between the outlet of the exhaust duct 65 and the fan 62 so that air can be directly blown to the heaters 61.

The RPM of the fan 62 is controlled by the BLDC motor 63. The BLDC motor may function to adjust the flow rate differently for different operation-periods by varying the RPM in respective operations, and may allow different regions in the drying rack 22 to be dried by varying the circulation flow pattern of air inside the tub 2.

Due to the fact that the lower rack 222 and the exhaust port 52 have the same height and the fact that the cross-sectional shape of the cap 56 provided on the exhaust port 52 is defined by the conical passages 563, the flow of air inside the tub 2 may be adjusted merely by adjusting the RPM of the fan 62. Considering the flow of air discharged from the exhaust port 52, the heated air discharged from the exhaust port 52 moves upward through the lower rack 222, and thereafter returns to the suction port 51. That is, the discharged air circulates inside the tub 2.

When the fan 62 is rotated at a first RPM, the dryness of dishes placed on the lower rack 222 is increased, and, among the washing objects received in the upper rack 221, the dryness of dishes located in a region distant from the suction port 51 is higher than the dryness of dishes located in a region close to the suction port 51. When the fan 62 is rotated at a second RPM, which is lower than the first RPM, the dryness of the dishes on the upper rack 221 is higher in the region close to the suction port 51 than in the region distant from the suction port 51.

That is, in the case of dishes placed on the lower rack 222, the drying course is rapidly performed as the RPM of the fan 62 is increased. In the case of dishes placed on the upper rack 221, dishes in the region distant from the suction port 51 have a higher dryness when the RPM of the fan 62 corresponds to the first RPM, and dishes in the region close to the suction port 51 have a higher dryness when the RPM of the fan 62 corresponds to the second RPM.

Accordingly, all of the dishes inside the tub 2 may be evenly dried as the motor 63 varies the RPM so as to control the flow rate of air. The RPM of the fan 62 may be changed at least one time during the operation of the heaters 61.

The suction duct 64 communicates with the suction flow-path 53 of the flow-path unit 5, and the exhaust duct 65 communicates with the exhaust flow-path 54 of the flow-path unit 5. The exhaust duct 65 may include a first housing 651 and a second housing 652, and the second housing 652 may communicate with the suction duct 64.

Although all of the heaters 61 and the fan 62 may be provided inside the first housing 651 and the second housing 652, which constitute the exhaust duct 65, the present invention is not limited thereto.

The exhaust duct 65, which incorporates the PTC heaters therein, is formed of a poly phenylene sulfide (PPS) material, which may resist high temperatures.

Considering briefly the general flow of air, the air inside the tub 2 is introduced into the flow-path unit 5 through the suction port 51. The air moves from the suction port 51 to the suction duct 64 through the suction flow-path 53. The air inside the suction duct 64 passes through the two or more heaters 61 inside the exhaust duct 65 via the operation of the fan 62. The air, heated while passing through the heaters 61, moves from the exhaust duct 65 to the exhaust port 52 through the exhaust flow-path 54 of the flow-path unit 5 to thereby be discharged to the inside of the tub 2. As described above, the air discharged to the inside of the tub 2 is changed in flow inside the tub 2 based on the RPM of the fan 62 by the BLDC motor 250.

When the air continuously circulates inside the tub 2, the air is gradually moistened. In order to remove the moist air, a door 30 may be opened while the drying course is performed (in other words, while the heaters are operated). It is possible to discharge the air, which becomes moist while circulating inside the tub 2, the outside of the dishwasher 1 by opening the door 11 at least one time during the operation of the heaters 61.

All of the two or more heaters 61 may be operated simultaneously with the opening of the door 11. This serves to prevent the temperature inside the tub 2 from being reduced as the heated air inside the tub 2 is discharged to the outside when the door 11 is opened. In addition, this serves to allow the moisture remaining inside the tub to be more rapidly evaporated via the operation of the two or more heaters 61.

In addition, the RPM of the fan 62 may be increased simultaneously with the opening of the door 11, compared to before the opening of the door 11. When the RPM of the fan 62 is increased simultaneously with the opening of the door 11, the flow rate of air is increased, which ensures the smoother discharge of the moist air.

FIG. 7 illustrates an embodiment of a control method related to the opening of the door 11. Setting a washing course is an operation in which a user can select, in advance, a washing course based on the kind of laundry. Setting a drying time is an operation in which the user can select, in advance, the total drying time of the laundry.

Considering the algorithm in detail, a drying operation S20 is performed after the washing course and the drying time are set (S10). The humidify H inside the tub is frequently measured (S30) while the drying operation S20 is performed, and the measured humidity H is compared with a preset reference humidity Hm (S40). When the comparison result is H>Hm, the door is opened (S50). When the comparison result is H<Hm, the drying operation is continuously performed (S20).

Although the reference humidity Hm may be set to the humidity at which water vapor is saturated, i.e. at which evaporation no longer occurs, in some cases, the reference humidity Hm may be set to the humidity immediately before water vapor is saturated in terms of drying efficiency.

When the door 11 is opened (S50), the humidity H inside the tub is continuously compared with the reference humidity Hm (S60). When the humidity H is higher than the reference humidity Hm, the door remains opened. When the humidity H is lower than the reference humidity Hm, the door is closed (S70).

After the door is closed (S70), the drying time, which is set at the beginning of washing, is compared with the actual implementation time of the drying operation (S80). As long as the implementation time of the drying operation does not exceed the set time, the drying operation is continuously performed (S20). When the implementation time of the drying operation exceeds the set time, the entire washing cycle ends.

The embodiment related to the opening of the door is simplified compared to the existing dehumidification method and prevents additional power consumption for dehumidification. Meanwhile, the door 30 may be set so as to be opened when the RPM of the fan 62 is changed.

In another embodiment related to dehumidification, a water tank (not illustrated) may be installed in the space in the flow-path unit 5, which surrounds the suction port 51 and the suction flow-path 53. Water, supplied to the water tank before drying, undergoes heat exchange with moist air introduced into the suction port 51 after has circulated inside the tub 2. Condensed water, generated via the heat exchange in the suction port 51 and the suction flow-path 53, is discharged from a condensed water discharge hole (not illustrated), which is formed at the end of the suction flow-path, prior to being introduced into the suction duct.

The present invention may be altered and implemented in various forms, and the scope of the present invention is not limited to the above-described embodiments. Accordingly, the alterations should be considered to fall within the scope of the present invention so long as they include constituent elements of the claims of the present invention.

MODE FOR INVENTION

As described above, a related description has sufficiently been discussed in the above "Best Mode" for implementation of the present invention.

INDUSTRIAL APPLICABILITY

As described above, the present invention may be wholly or partially applied to a dishwasher having a heating circulation type drying module.

The invention claimed is:

1. A dishwasher comprising:

a cabinet;

a tub provided in the cabinet defining a washing space;

a door for selectively opening and closing the tub;

a flow-path unit including a suction flow-path connecting a suction port and a suction duct to each other and an exhaust flow-path connecting an exhaust port and an exhaust duct to each other, the flow-path unit circulating air inside the tub through the suction port and the exhaust port, which communicate with the tub; and a heating unit including the suction duct communicating with the suction port, an exhaust duct communicating with the suction duct and the exhaust port, at least two heaters provided inside the exhaust duct heating the air and which are controlled independently of each other so as to adjust a temperature of the air, and a fan supplying the air to the heaters, wherein the door is opened at least one time during operation of the heaters when the humidity inside the dishwasher is higher than a reference humidity, and the door is closed when the humidity inside the dishwasher is lower than the reference humidity, wherein the at least two heaters are operated when the door remains opened, wherein the door remains opened when the air inside the tub reaches a reference humidity, and wherein the heaters are positive temperature coefficient (PTC) heaters.

2. The dishwasher according to claim 1, wherein an RPM of the fan is changed at least one time during operation of the heaters.

3. The dishwasher according to claim 2, wherein the door is opened simultaneously with a change in the RPM of the fan.

4. The dishwasher according to claim 2, wherein the RPM of the fan after the door is opened is greater than the RPM of the fan before the door is opened.

5. The dishwasher according to claim 1, wherein each of the suction flow-path and the exhaust flow-path extends upward from the suction port or the exhaust port by a prescribed distance in order to prevent introduction of wash water.

6. The dishwasher according to claim 1, wherein the suction port is located higher than the exhaust port.

7. The dishwasher according to claim 5, wherein the exhaust flow-path is provided with a rib for assisting a flow of air from the exhaust duct to the exhaust port.

8. The dishwasher according to claim 1, wherein at least one of the suction port and the exhaust port has a cap detachably fastened thereto.

9. The dishwasher according to claim 5, wherein a plurality of drain holes, through which wash water introduced into the cap is drained, is formed in an outer portion of the cap.

10. The dishwasher according to claim 9, wherein a plurality of passages, through which air passes, is provided in an inner portion of the cap.

11. The dishwasher according to claim 5, further comprising:

an upper rack provided inside the tub; and a lower rack provided under the upper rack, wherein the exhaust port is located at the same height as the lower rack.

* * * * *